United States Patent [19]

Foster

[11] 4,198,796

[45] Apr. 22, 1980

[54] THERMAL INSULATION STRUCTURE

[75] Inventor: Kenneth J. Foster, Dedham, Mass.

[73] Assignee: Massachusetts Institute of Technology, Cambridge, Mass.

[21] Appl. No.: 831,307

[22] Filed: Sep. 7, 1977

[51] Int. Cl.[2] ..... E06B 3/28

[52] U.S. Cl. ..... 52/203; 52/171; 52/799

[58] Field of Search ..... 52/171, 203, 616, 618, 52/306, 202, 790, 799; 350/258, 259, 260

[56] References Cited

U.S. PATENT DOCUMENTS

| | | | |
|---|---|---|---|
| 2,695,430 | 11/1954 | Wakefield | 350/258 X |
| 2,828,235 | 3/1958 | Holland et al. | 52/618 X |
| 3,202,054 | 8/1965 | Mochel | 52/171 X |
| 3,220,065 | 11/1965 | Graham | 350/258 X |
| 4,035,539 | 7/1977 | Luboshez | 52/618 X |
| 4,038,797 | 8/1977 | Hermann et al. | 52/616 X |
| 4,041,663 | 8/1977 | Mazzoni | 52/203 |

FOREIGN PATENT DOCUMENTS

| | | | |
|---|---|---|---|
| 2335662 | 7/1977 | France | 52/203 |

*Primary Examiner*—Carl D. Friedman

*Attorney, Agent, or Firm*—Arthur A. Smith, Jr.; Paul J. Cook

[57] ABSTRACT

A thermal insulation structure for windows including a plastic multi-cell layer, a flat transparent plastic sheet supporting the cell layer, ribbing support for each cell on the flat sheet and a transparent adhesive coated on the flat sheet. The insulation structure is transparent to outside light and provides a simple means for significantly reducing heat loss through the window.

17 Claims, 5 Drawing Figures

THERMAL INSULATION STRUCTURE

BACKGROUND OF THE INVENTION

This invention relates to a composite structure adapted to provide thermal insulation for windows.

Window heat loss accounts for about 20–40% of building space heating costs. With continuing increases in fuel costs, existing structures require an inexpensive and practical means for converting single pane glass windows to thermal insulators. Presently employed means include double paned windows constructed to form a sealed air space between the panes. Alternatively, an equivalent second (storm) window is added to function in conjunction with the window to form an insulating air space. The present insulating means are undesirable since they are expensive to make and to install. Furthermore, even though these double pane arrangements reduce heat loss due to conduction through the outside glass pane, there is still substantial heat loss caused by convection of the air within the air space which promotes conduction heat loss through the outside pane.

It would be desirable to promote a means for thermally insulating glass windows with little or no structural modification. Furthermore, it would be desirable to provide a glass thermal insulation means which requires little or no labor costs and which can be produced without the need for special installation tools. In addition, it would be desirable to provide a thermal insulation means for glass windows which can be modified easily to change its light transmission or reflectance characteristics thereby to permit its preferential use at different exposures of a building. Furthermore, it would be desirable to provide such a thermal insulation means which minimizes convection heat loss.

SUMMARY OF THE INVENTION

This invention provides a window insulation means which provides effective thermal insulation without drastically changing the light transmission function of the window. The insulation means comprises a transparent composite flexible plastic structure including a flat sheet, a layer comprising plastic cells attached to the flat sheet wherein the cells are surrounded by plastic reinforcing means also attached to the flat sheet and a transparent, pressure-sensitive adhesive layer coated on the exposed surface of the cells opposite the cell surfaces attached to the flat sheet. The adhesive is transparent, resistant to degradation by ultraviolet light or temperature and resistant to moisture such as that which normally forms by condensation on windows. The reinforcing members surrounding each cell preferably provide reinforcement to adjacent cells and are formed integrally therewith. The composite structure is self-supporting and is applied to a window by being adhered thereto with the pressure-sensitive adhesive layer. The resultant insulated window, when in place in a building structure, then permits light to enter the building interior while providing effective thermal insulation between the inside and outside environments.

DETAILED DESCRIPTION OF PREFERRED EMBODIMENTS

Figure 1:
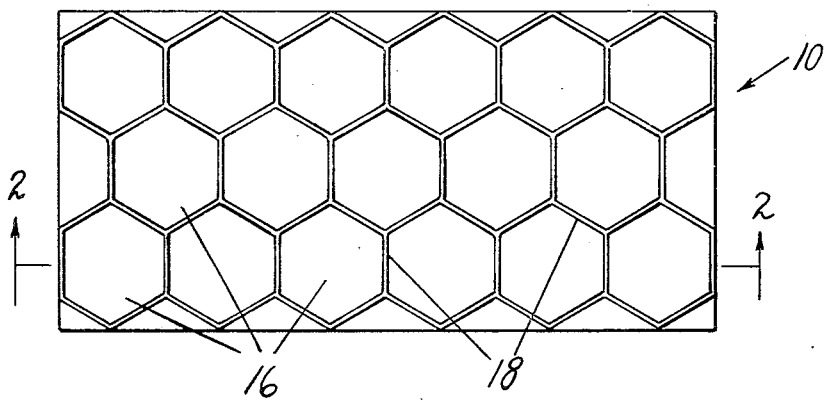
FIG. 1 is a top view of the thermal insulation structure of this invention.

The thermal insulation structure creates a trapped dead air space on the inside surface of a window thereby providing effective thermal insulation between the outdoor and indoor environments. The cells or bubbles have a depth between about ⅛ inch and 1¼ inch, preferably between about ¼ inch and ½ inch. It has been found that when the depth of the cells or bubbles exceeds about 1 inch, air convection within each cell increases thermal conduction through the window.

When the depth and width of the cells is less than about ⅛ inch, there is substantial heat loss due to conduction through the walls of the cells and hence through the window. The cells have a major diameter of between about ⅛ inch and 1¼ inch, preferably between about ¼ inch and ½ inch. The supporting walls for each cell preferably are positioned to provide a common support or ribbing for adjacent cells and to prevent convection between the cells. For example, the peripheral shape of the cells can be triangular, square, hexangonal or the like with the hexagonal shaped cells being preferred because of the ease of manufacturing and good mechanical strength while greatly reducing the amount of cell wall to cell volume as compared to other ribbing arrangements.

Numerous materials known as plastics can be utilized. These include polyethylene terephthalate, acrylonitrile-vinylidene chloride copolymers, polyvinyl chloride, polyvinylidine chloride, polyethylene, polycarbonates and fluorocarbon polymers or the like which can be reinforced with fibers if desired. The plastic compositions can contain the usual resin additives such as ultraviolet light stabilizers, smoke or flame retardants, plasticizers or the like. In addition, the plastic compositions can contain a colorant or filler composition or the like to render a portion of the cell walls or plastic sheet partially opaque to selected wavelengths of light for light or heat control or for aesthetic reasons. In one aspect of this invention, the plastic compositions include additives which permit control of the light transmission characteristics of the plastic compositions. In one aspect, infrared absorbent compositions such as those used to produce solar bronze and solar gray glass and platics and the like can be added to the plastic compositions forming the flat sheets and/or the cells. The infrared absorber composition absorbs infrared radiation from the sun and reradiates the absorbed energy isotropically in longer wavelengths so that the infrared absorber acts to reduce and redistribute the infrared radiation transmission from the sun to the interior of the building. In this mode, the insulating means of this invention is used when it is desired to maintain the interior of the building cool. Alternatively, the cell and/or flat sheet can be coated with a thin metallized layer such as aluminum or silver in the order of about 200 Angstroms thick so that a portion of the visible light can be transmitted through the insulation structure while reflecting the infrared radiation from the sun. In addition, the cell walls can be tinted to reduce the total amount of radiation transmitted thereby to achieve substantially the same effect. The infrared radiation generated by normal room heat has a wavelength of about 3 to 150 microns, which is a longer wavelength than the sun's infrared radiation. It is desirable to prevent this long wavelength infrared from reaching the window glass in order to conserve room heat. This may be accomplished by additives to the plastic composition which are substantially transparent to visible light and substantially absorbent or opaque to the long wavelength room heat infrared radiation. Suitable additives for this purpose include the transparent or translucent metallic fluorides such as $AlF_3.3NaF$, $CaF_2$, $MgF_2$,$KBF_4$, $Na_2SiF_6$, and the like as well as other long wavelength infrared absorbers known in the art. Alternatively, the cells and/or flat sheet can be coated with a material added to the composition of the plastic which reflects the room heat back into the room while transmitting solar visible and infrared radiation. Representative suitable coating compositions for this purpose include thin metallic coatings, multilayer thin dielectric or dielectric/metal coatings, doped semiconductor coatings, thin film metallic or semiconductor grids or the like. Thus, as is evident from the above, the insulation structure of this invention can be modified with compositions having the appropriate light absorbance or reflectance characteristics to regulate the frequency of radiation entering or retained within a room.

The adhesive composition must provide sufficient tack to retain the structure in place on the window. The adhesive composition should be capable of retaining its adhesive characteristics over a wide temperature range, e.g. from about −40° C. to about 130° C. In addition, the adhesive composition should be capable of withstanding extreme exposure to the sun's radiation including the effects of visible, infrared and ultraviolet light and of moisture which may be present from condensation on the inside surface of a window. Furthermore, the adhesive should be relatively transparent to visible light. In addition, the adhesive should provide shear stability under the constant shear forces exerted by the force of gravity. Representative suitable adhesives are based upon silicone resins, butyl resins, acrylic resins, hot melts or the like. For purposes of the present invention, a long chain, high molecular weight, elastomeric, aliphatic serves the purpose best. The adhesive is designed to have specific adhesion for a variety of hydrophobic, essentially non-polar plastics, and only limited non-specific adhesion to glass, especially maintaining this adhesive balance upon long-term ageing. It should be pointed out that at some point, it may be desired to remove the insulation from the glass surface; hence, the special requirement for the adhesive to provide just the proper tack, which allows for a sufficient attachment, but yet is not permanent, whereby the insulation structure can be removed at certain time intervals. A particularly suitable adhesive has the following formulation:

| Components | Content by Weight |
|---|---|
| 2 ethyl hexyl acrylate | 30 |
| dioctyl maleate | 30 |
| vinyl acetate | 20 |
| ethyl acrylate | 20 |
| Na salt of the sulfate of t-octyl phenoxy ehtoxy ethanol | 3.8 |
| ammonium persulfate | 0.165 |
| methacrylic acid | 0.75 |
| diallyl maleate | 0.07 |

-continued

| Components | Content by Weight |
|---|---|
| water | 102 |

This adhesive is produced by the process of emulsion polymerization at a temperature of 80° C. for a reaction time of about 4 hours. After the reaction is complete, conversion is 99.8%, the adhesive is in the form of a fine particle dispersion, particle size ranges from about 0.2 to 0.8 microns, averageing 0.4 microns. This adhesive is chemically referred to as a modified acrylic tetramer. The average molecular weight of the adhesive is about 80,000. The adhesive is very elastomeric, possesses excellent specific tack to nonpolar plastics; is very water resistant and possesses extreme stability to radiation. The adhesive also maintains an aggressive tack over a broad temperature range of about −40° C. to about 130° C. This adhesive is applied by conventional coating techniques to the insulation structure of this invention. The method of application, the configuration of deposit and the amount of deposition are all variables that can be controlled for optimum end-use performance. Thus, for example, the adhesive can be layered or intermittently applied to the cellular structure. It is preferred that the adhesive composition preferentially stick to the plastic sheet so that it can be removed easily if desired.

The composite structure of this invention provides substantial advantages over prior art proposals for thermally insulating windows. The thermal insulation can be hand-applied to a window conveniently by cutting the insulation to the desired size, removing a conventional release medium, if utilized, such as a silicone-coated paper or plastic film from the adhesive and laying the insulation on the window with the adhesive in contact with the glass. Also, the thermal insulation is positioned from the inside without being adversly affected by the weather. In addition, the thermal insulation is self-supporting and does not require additional supporting means. Obviously, this invention requires less labor than is necessary for forming double-paned, sealed windows or for positioning storm windows. Furthermore, the material cost is far less than that of double-paned or storm windows. Furthermore, the thermal insulation of this invention can be positioned on only parts of the window so that, for example, it can be placed on the top portion of the window where heat losses are greater while permitting a complete view through the bottom portion of the window corresponding to normal eye level. The thermal insulation also diffuses sunlight in an essentially hemispherical distribution and is particularly useful where it is desired to avoid direct sunlight such as to increase comfort, reduce building cooling cost and promote more uniform plant growth in buildings such as greenhouses. In addition, the thermal insulation, once positioned, does not interfere with the normal operation of the window, so that it can be raised, lowered or swung as was possible in its unmodified state. The thermal insulation also provides a measure of acoustical attenuation, security screening and provides a safety feature in that the glass will not shatter if broken. In addition, since the thermal insulation is a low mass structure, it imposes no mechanical stress on the glass or window frame. The thermal insulation can be applied as a single composite or as a plurality of superimposed composites one on another thereby to increase thermal insulation. Furthermore, the insulation can be applied to ordinary glass or double-paned glass structures.

Figure 2:
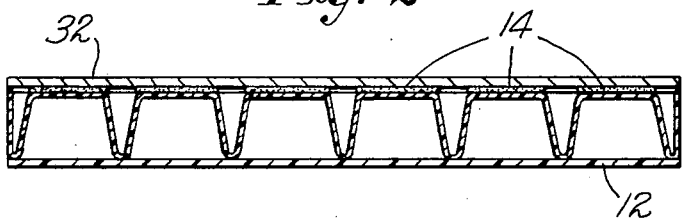
FIG. 2 is a cross-sectional view of the structure of FIG. 1, taken along line 2—2.
Figure 3:
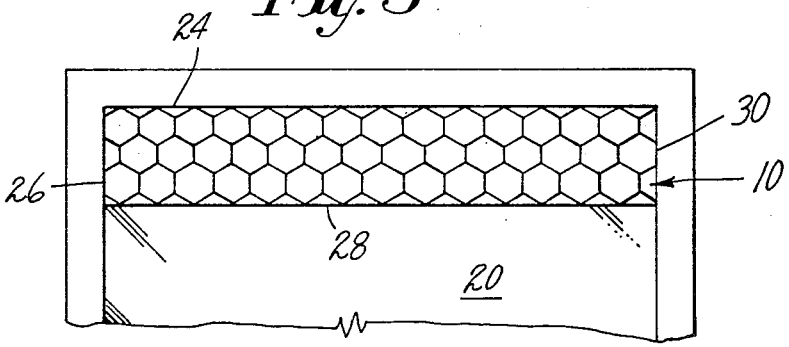
FIG. 3 is a perspective view of the thermal insulation of this invention in place on a window.

Referring to FIGS. 1–3, the thermal insulation composite structure 10 comprises a flat transparent sheet 12, a transparent pressure sensitive adhesive coating 14 and a plurality of cells 16 formed of transparent plastic. The cells 16 are supported by hexagonal shaped ribs 18 which can be formed integrally with the cells 16 and then heat sealed to the flat sheet 12 or adhesively bonded or otherwise bonded. The cells 16 can be sealed or unsealed as desired with the unsealed configuration being the preferred embodiment. The unsealed cells are less subject to deliberate rupture or "popping" and create less mechanical stress on both the cell walls and the adhesive-window bond interface during temperature changes. When it is desired to place the thermal insulation 10 on a window 20 in frame 22, the insulation is cut so that the edges 24, 26, 28 and 30 correspond to the area of the window 20 desired to be insulated. A release paper or film 32 is removed from contact with the adhesive 14 and the adhesive is pressed in contact with the window 20. If desired, the release paper or film 32 can be eliminated by rendering the exposed surface of the flat sheet 12 with release characteristics so that the adhesive coatings do not permanently adhere to the exposed surface of the flat sheet when the thermal insulation sheets are stacked or rolled.

Figure 4:
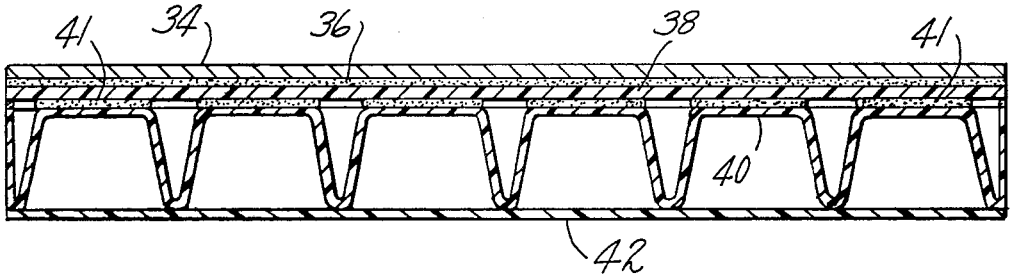
FIG. 4 is a cross-sectional view of an alternative embodiment of this invention.

Referring to FIG. 4, the composite structure comprises a release paper or film 34, an adhesive layer 36, a flat plastic transparent sheet 38, a cellular layer 40 and a flat transparent plastic sheet 42.

Figure 5:
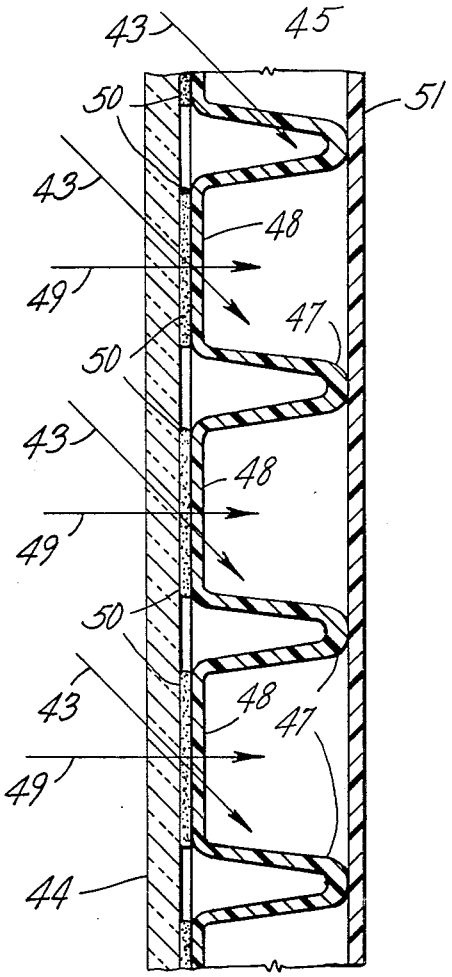
FIG. 5 is a close-up view of the plastic cell arrangement containing a tinting composition.

As shown in FIG. 5, the thermal insulation of this invention can be modified to render a room cool. During the summer, the most intense sun rays 43 pass through the glass pane 44 at a high angle. The cells 45 are formed from a plastic composition containing a colorant, pigment, reflective coating or the like which absorbs the light or reflects the sunlight back through the pane 44. The cells 45 are formed by molding, such as by vacuum molding a plastic sheet containing the colorant, pigment or coating. The support portion 47 of the cells have thicker walls than the upper face portion 48 of the cells so that the color in the walls 47 is more optically dense than the face portion 48. In the case of the reflective coating, the coating is more optically dense on the walls than the face portion. Thus the walls 47 prevent or reduce the sun rays 43 entering at a high angle from entering the room. When the sun rays 49 are less intense and at a lower angle, the rays 49 pass through the pane 44, the transparent adhesive 50 and the transparent flat sheet 51. The thermal insulation thus acts also as a solar shade, preferentially reducing solar loading when the sun is at a higher elevation and is most intense.

In addition to window insulation, the insulation structure of this invention can be used as wall insulation by applying a heat reflective layer either on the flat sheet or on the cells or on the second flat sheet 38 shown in FIG. 4 and applying adhesive to the cells or to that surface of the second flat sheet which is not attached to the insulation structure so that the resultant structure can be attached to a wall with the reflective layer facing into the room. If desired, a decorative facing can be adhered to the surface of the insulation structure opposite to the surface adhered to the wall.

The following example illustrates the present invention and is not intended to limit the same.

EXAMPLE I

The window shown in the drawings comprises a ¼ inch thick cullular light-admitting and thermally insulating blanket fabricated from a flexible transparent plastic was pre-cut to size and applied to the inside of a window by means of a transparent permanent-tack pressure-sensitive adhesive coated on one side of the cellular material. The material creates a trapped, dead air space ¼ inch thick on the inside surface of the window thereby reducing the thermal conduction of heat through the window.

Standard window glass has a transmission heat loss ($U_w$) of 1.13 Btu per square foot per hour for each degree farenheit of temperature difference between the inside and outside air temperatures. The U value is the overall heat transmission coefficient. Thermopane TM consists of two panes of window glass separated by a relatively thin air space. ASHRAE Handbook of Fundamentals (American Society of Heating, Refrigeration and Air Conditioning Engineers) gives a heat transmission coefficient $U_{2w}$ of 0.69 for double glass separated by a 3/16 inch air space. The 3/16 inch Thermopane TM heat transmission loss is thus reduced to $U_{2w}/U_w=0.69/1.13-0.61$ of single glass windows, corresponding to a 39% heat energy savings.

By comparison then, the window insulation of this invention should provide essentially the same magnitude, 40%, of heat loss reduction and energy savings as Thermopane TM windows. The energy savings could be slightly higher because the honeycomb cellular structure of the insulation breaks up air convection currents that exist even within the interior of double glass windows of small spacing.

Instrumented laboratory and window tests were conducted to determine the actual thermal insulation characteristics and heat savings of the installed insulation material.

In the first experiment, a rectangular glass walled tank with a volume of two cubic feet, insulated top and bottom with 4 inch thick Styrofoam, was filled with ice water and the temperature rise of the water due to heat gain through the glass walls of the tank was monitored both with and without the insulation applied to the walls of the tank. The glass wall surface area was approximately 6 $ft^2$ and the room temperature was also constantly monitored.

The overall heat transfer coefficients were deduced with and without the insulation and the thermal insulating efficiency and heat savings of the insulation applied to glass windows was determined. Neglecting heat gain through the tank top and bottom foam insulation, the insulation reduced the heat transmission through the glass walls of the tank by 43%. Translating this to heat savings with the insulation mounted on a window with air as the outside heat sink medium as opposed to water, as in the tank, gives an indicated heat loss reduction of 37%. Analysis of the errors caused by neglecting heat gain through the tank foam insulation increases the heat savings by several percent, to a nominal 40% as predicted by comparison to Thermopane TM. Details of the experiment and calculations are presented below.

The second experiment consisted of attaching thermocouples to the inside and outside glass surface of two adjacent exterior window panes, insulating the inside of one of the panes with the insulating material and monitoring the temperature drops $\Delta t$ across the window glass for each case. Heat transfer (loss) from the room through the glass is directly proportional to the temperature difference $\Delta t=(t_{in}-t_{out})$ across the glass and the ratio between the temperature drop of the insulated glass $\Delta t_n$ and the drop $\Delta t_g$ across the plane glass window gives the reduction in heat loss for the insulated window.

$$\frac{\Delta t_n}{\Delta t_g} = \frac{(t_{in} - t_{out})_n}{(t_{in} - t_{out})_g}$$

Inserting the measured and averaged inside and outside temperature values gives:

$$\frac{\Delta t_n}{\Delta t_g} = \frac{(50.93^\circ \text{ F.} - 50.23^\circ \text{ F.})_n}{(54.1^\circ \text{ F.} - 52.85^\circ \text{ F.})_g} = 0.56$$

The heat loss through the insulated window is then 0.56 of that through the uninsulated window corresponding to a heat loss reduction or energy savings of 44%. The expression used to find the overall heat transfer coefficient for Experiment I is:

$$U = \frac{(\rho_{cp}V)_w}{A} - \frac{\ln\left(\frac{T_{wo} - T_r}{T_{w1} - T_r}\right)}{(t_1 - t_o)}$$

where $T_{w1}$ is the water temperature at time $t_1$

U=heat transfer coefficient

V=tank volume

A=tank glass wall $(\ )_r$=refers to water $(\ )_w$=refers to water

T=temperature

| Experiment I - No Insulation on Tank Glass Walls | | | |
|---|---|---|---|
| Reading | Time | Room T° C. | Tank Water T° C. |
| a | 1:17 PM | 24.6 | 8.20 |
| b | 1:37 | 24.5 | 8.55 |
| c | 1:57 | 24.6 | 8.95 |
| d | 2:17 | 24.6 | 9.30 |
| e | 2:37 | 24.6 | 9.60 |
| f | 2:57 | 24.8 | 9.95 |
| g | 3:17 | 24.85 | 10.29 |

The average heat transfer coefficient for all the time intervals is:

$h_{avgo}$=1.43 with a standard deviation of $\sigma$=0.0705

| Experiment II with ¼ Inch Thick Thermalite Material Covering the Glass Wall of the Tank | | | |
|---|---|---|---|
| Reading | Time | Room T° C. | Tank Water T° C. |
| a | 4:00 PM | 26.8 | 8.50 |
| b | 4:21 | 27.7 | 8.73 |
| c | 4:40 | 26.6 | 9.00 |
| d | 5:00 | 26.2 | 9.22 |
| e | 5:20 | 26.2 | 9.45 |
| f | 5:40 | 25.9 | 9.62 |
| g | 6:00 | 25.8 | 9.96 |
| h | 6:20 | 26.4 | 10.10 |
| i | 6:40 | 26.8 | 10.35 |
| j | 7:00 | 26.7 | 10.48 |
| k | 7:21 | 26.5 | 10.90 |
| l | 7:40 | 26.9 | 11.09 |
| m | 8:00 | 26.2 | 11.32 |
| n | 8:20 | 26.1 | 11.50 |
| o | 8:40 | 25.8 | 11.69 |
| p | 9:00 | 26.1 | 11.89 |

-continued

| Experiment II with ¼ Inch Thick Thermalite Material Covering the Glass Wall of the Tank | | | |
|---|---|---|---|
| Reading | Time | Room T° C. | Tank Water T° C. |
| q | 9:20 | 25.9 | 12.07 |

The average heat transfer coefficient for all the time intervals is:

$h_{avgn}$=0.821 with a standard deviation of $\sigma$=0.055.

The resistance to heat flow is 1/h. Assuming the film heat transfer coefficients were the same in both tests, the additional thermal resistance of Thermalite ($k/h_n$) attached to the tank glass wall is simply the average resistance of the tank glass wall with Thermalite insulation ($1/h_{avgn}$) minus the average tank glass wall thermal resistance ($1/h_{avgo}$) without insulation.

$$\frac{1}{h_n} = \frac{1}{h_{avgn}} - \frac{1}{h_{avgo}}$$

The resistance of window glass ($1/h_g$) in winter is 1.13 and the total resistance ($1/h_t$) of window glass with Thermalite insulation is:

$$\frac{1}{h_t} = \frac{1}{h_g} + \frac{1}{h_n}$$

Heat loss with insulation compared to that with plane glass is:

$$\dot{q}_g = h_g(\Delta T);\ \dot{q}_n = (1/h_g + 1/h_n)^{-1}(\Delta t)$$

$$\dot{q}_n = \frac{(1/h_g + 1/h_n)^{-1}}{h_g}\dot{q}_g \frac{(1/h_g)}{(1/h_g + 1/h_n)}\dot{q}_g$$

The percentage reduction in heat loss is:

$$\%\text{ reduction} = 1 - \frac{1/h_g}{(1/h_g + 1/h_n)}$$

Summarizing:

| $1/h_n$ | $1/h_t$ | $\dot{q}_n/\dot{q}_g$ | Percent Reduction in Heat Loss |
|---|---|---|---|
| 0.519 | 1.404 | (63%) | 37% |

I claim:

1. A flexible thermal insulation structure which comprises a flat plastic sheet, a layer of plastic cells attached to said flat sheet, ribbing support for each cell on said flat sheet and a transparent adhesive layer on a first surface of said cells opposite the surface of said cells attached to said flat sheet, each of said cells having a depth and a major diameter of between about ⅛ inch and 1¼ inch, said structure adapted to be adhered to window glass and having a sufficiently low mass as to impose substantially no mechanical stress on said window glass, said structure being sufficiently flexible as to impose substantially no mechanical stress on said window glass due to temperature changes at the interface between said adhesive and said window glass and said cells having walls positioned to provide a common support or ribbing for adjacent cells.

2. The structure of claim 1 wherein the ribbing for each cell is hexagonal.

3. A thermally insulated glass structure which comprises a glass sheet having adhered to one surface thereof the structure of claim 2.

4. A thermally insulated glass structure which comprises a glass sheet having adhered to one surface thereof a plurality of the structures of claim 2 superimposed on each other.

5. The structure of claim 1 wherein the cells and ribbing are formed from a common plastic sheet or extruded melt.

6. A thermally insulated glass structure which comprises a glass sheet having adhered to one surface thereof a plurality of the structures of claim 5 superimposed on each other.

7. The structure of claim 1 wherein a second flat plastic sheet is adhered to said first surface of said cells and a transparent adhesive layer on the surface of said second flat plastic sheet opposite the surface adhered to said cells.

8. The structure of claim 7 wherein the plastic composition forming said structure includes a composition capable of absorbing visible radiation, infrared radiation or visible and infrared radiation.

9. A thermally insulated glass structure which comprises a glass sheet having adhered to one surface thereof a plurality of the structures of claim 8 superimposed on each other.

10. A thermally insulated glass structure which comprises a glass sheet having adhered to one surface thereof the structure of claim 7.

11. A thermally insulated glass structure which comprises a glass sheet having adhered to one surface thereof a plurality of the structures of claim 7 superimposed on each other.

12. The structure of claim 1 wherein the plastic composition forming said structure includes a composition capable of absorbing visible radiation, infrared radiation or visible and infrared radiation.

13. A thermally insulated glass structure which comprises a glass sheet having adhered to one surface thereof a plurality of the structures of claim 12 superimposed on each other.

14. The structure of claim 1 wherein the plastic composition utilized in said structure includes a light reflective composition or coating.

15. A thermally insulated structure which comprises a glass sheet having adhered to one surface thereof a plurality of the structures of claim 14 superimposed on each other.

16. A thermally insulated glass structure which comprises a glass sheet having adhered to one surface thereof the structure of claim 1.

17. A thermally insulated glass structure which comprises a glass sheet having adhered to one surface thereof a plurality of the structures of claim 1 superimposed on each other.

* * * * *